US006533386B1

(12) United States Patent
Sawicki et al.

(10) Patent No.: US 6,533,386 B1
(45) Date of Patent: Mar. 18, 2003

(54) CAM-ACTUATED LEVER CAPPING ARM

(75) Inventors: Paul F. Sawicki, Rochester, NY (US); Richard H. Berg, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/721,954

(22) Filed: Nov. 27, 2000

(51) Int. Cl.[7] ..... B41J 2/165
(52) U.S. Cl. ..... 347/32; 347/29
(58) Field of Search ..... 347/32, 29, 30

(56) References Cited

U.S. PATENT DOCUMENTS

| | | | | |
|---|---|---|---|---|
| 4,500,895 A | * | 2/1985 | Buck et al. | 347/87 |
| 4,746,938 A | | 5/1988 | Yamamori et al. | |
| 4,853,717 A | | 8/1989 | Harmon et al. | |
| 4,855,764 A | | 8/1989 | Humbs et al. | |
| 5,055,856 A | * | 10/1991 | Tomii et al. | 347/30 |
| 5,097,276 A | * | 3/1992 | Midorikawa | 347/32 |
| 5,151,715 A | | 9/1992 | Ward et al. | |
| 5,250,962 A | | 10/1993 | Fisher et al. | |
| 5,339,102 A | | 8/1994 | Carlotta | |
| 5,500,659 A | | 3/1996 | Curran, Jr. et al. | |
| 5,548,310 A | | 8/1996 | Binnert et al. | |
| 5,659,341 A | | 8/1997 | Kinas | |
| 5,943,071 A | | 8/1999 | Premnath et al. | |
| 6,130,684 A | | 10/2000 | Premnath et al. | |

FOREIGN PATENT DOCUMENTS

JP 411138831 A * 5/1999 ..... B41J/2/165

* cited by examiner

*Primary Examiner*—Thinh Nguyen
(74) *Attorney, Agent, or Firm*—Oliff & Berridge, PLC

(57) ABSTRACT

A method and system for a cam-actuated lever capping arm for use in a maintenance station of an ink jet printer, the printer including a bi-directional translatable carriage supporting a print cartridge having a print head with nozzles in a nozzle face for printing ink droplets ejecting from said nozzles onto a recording medium at a printing zone in the printer, the translatable carriage being controlled by drive members under the control of a printer controller, the maintenance station being positioned at one side of the printing zone for translation of a print cartridge thereto on the translatable carriage for capping by the cap carriage, the cap carriage including, a pair of movable caps for sealing the nozzles in the printhead nozzle face, and a cam-actuated lever for moving the cap into a position in which the cap seals against the printhead nozzle face.

2 Claims, 4 Drawing Sheets

CAM-ACTUATED LEVER CAPPING ARM

BACKGROUND OF THE INVENTION

1. Field of Invention

This invention relates to maintenance stations for ink jet printing apparatus.

2. Description of Related Art

Fluid ejection systems, such as ink jet printers, have at least one fluid ejector head that directs droplets of fluid towards a receiving medium. Within the fluid ejector head, the fluid may be contained in a plurality of channels. Energy pulses are used to expel the droplets of fluid, as required, from orifices at the ends of the channels.

In a thermal fluid ejection system, such as a thermal ink jet printer, the energy pulses are usually produced by resistors. Each resistor is located in a respective one of the channels, and is individually addressable by current pulses to heat and vaporize fluid in the channels. As a vapor bubble grows in any one of the channels, fluid bulges from the channel orifice until the current pulse has ceased and the bubble begins to collapse. At that stage, the fluid within the channel retracts and separates from the bulging fluid to form a droplet moving in a direction away from the channel and towards the receiving medium. The channel is then re-filled by capillary action, which in turn draws fluid from a supply container. Operation of a thermal ink jet printer is described in, for example, U.S. Pat. 4,849,774, incorporated herein by reference in its entirety.

A carriage-type thermal ink jet printer is described in U.S. Pat. No. 4,638,337, incorporated herein by reference in its entirety. That printer has a plurality of printheads, each with its own ink tank cartridge, mounted on a reciprocating carriage. The channel orifices in each printhead are aligned perpendicular to the line of movement of the carriage. A swath of information is printed on the stationary receiving medium as the carriage is moved in one direction. The receiving medium is then stepped, perpendicular to the line of carriage movement, by a distance equal to or less than the width of the printed swath. The carriage is then moved in the reverse direction to print another swath of information.

The fluid ejecting orifices of a fluid ejector head need to be maintained, for example, by periodically cleaning the orifices when the fluid ejection system is in use, and/or by capping the fluid ejector head when the fluid ejection system is out of use or is idle for extended periods. Capping the fluid ejector head is intended to prevent the fluid in the fluid ejector head from drying out. The cap provides a controlled environment to prevent fluid exposed in the nozzles from drying out.

A fluid ejector head may also need to be primed before initial use, to ensure that the fluid ejector head channels are completely filled with the fluid and contain no contaminants or gas bubbles. After significant amounts of ejecting, and at the discretion of the user, an additional but reduced volume prime may be used to clear particles or gas bubbles that can cause defects in the ejected swath of information. Maintenance and/or priming stations for the printheads of various types of ink jet printers are described in, for example, U.S. Pat. Nos. 4,364,065; 4,855,764; 4,853,717 and 4,746,938, while the removal of gas from the ink reservoir of a printhead during printing is described in U.S. Pat. No. 4,679,059, each incorporated herein by reference in its entirety.

The priming operation, which usually involves either forcing or drawing fluid through the fluid ejector head, can leave drops of fluid on the face of the fluid ejector head. As a result, fluid residue builds up on the fluid ejector head face. This fluid residue can have a deleterious effect on the quality of the ejected swath of information. Material from the receiving medium and other foreign material can also collect on the fluid ejector head face while ejecting fluid. Like the fluid residue, this foreign material can also have deleterious effects on the quality of the ejected swath of information.

The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent discloses providing an ink jet printer with a washing unit which, at the end of the printing operation, directs water at the face of the printhead to clean the printhead before it is capped.

SUMMARY OF THE INVENTION

This invention provides a cam-activated lever capping arm for a maintenance station for a fluid ejector head that carries and actuates one or more caps movably mounted on a cap carriage to cap the fluid ejector head nozzles.

In one exemplary embodiment of the maintenance station according to this invention, one or more caps are mounted on a translatable carriage and moves with the carriage. When the fluid ejection system is ejecting fluid, the translatable carriage is located in an ejection zone, where the one or more fluid ejector heads can eject fluid onto a receiving medium. When the fluid ejection system is placed into a non-ejection mode, the translatable carriage can be translated to the maintenance station located outside and to one side of the ejection zone. Once the cartridge is translated to the maintenance station, various maintenance functions can be performed on the one or more fluid ejector heads of the fluid ejection system depending on the rotational position of a cam shaft in the maintenance station. The cam shaft rotates in one direction, such as, for example, counterclockwise, to engage and drive the hardware that in turn operates the individual maintenance functions.

Rotating the cam shaft activates various maintenance mechanisms of the maintenance station, including a cap carriage. After the one or more fluid ejector heads arrive at the maintenance station, a vacuum pump is energized, and the cap carriage is elevated to the position where the one or more caps engage the one or more fluid ejector heads. The one or more caps are mounted on the cap carriage in a capping location. The fluid ejector heads are primed when a pinch tube mechanism opens one or more pinch tubes connected to the one or more caps. Opening the pinch tubes releases negative pressure created by the vacuum pump. In response, fluid is drawn from the one or more fluid ejector heads into the one or more caps.

The vacuum pump is then deenergized, while the cap carriage remains in position so that the one or more caps cap the one or more fluid ejector heads awaiting the ejection mode of the fluid ejection system. Thus, the one or more fluid ejector heads remain capped at the maintenance station until the fluid ejection system is placed into the ejection mode.

These and other features and advantages of this invention are described in or are apparent from the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

The following detailed description of various exemplary embodiments of the fluid ejection systems according to this invention are directed to one specific type of fluid ejection system, an ink jet printer, for sake of clarity and familiarity. However, it should be appreciated that the principles of this invention, as outlined and/or discussed below, can be equally applied to any known or later developed fluid ejection system, beyond the ink jet printer specifically discussed herein.

Figure 1:
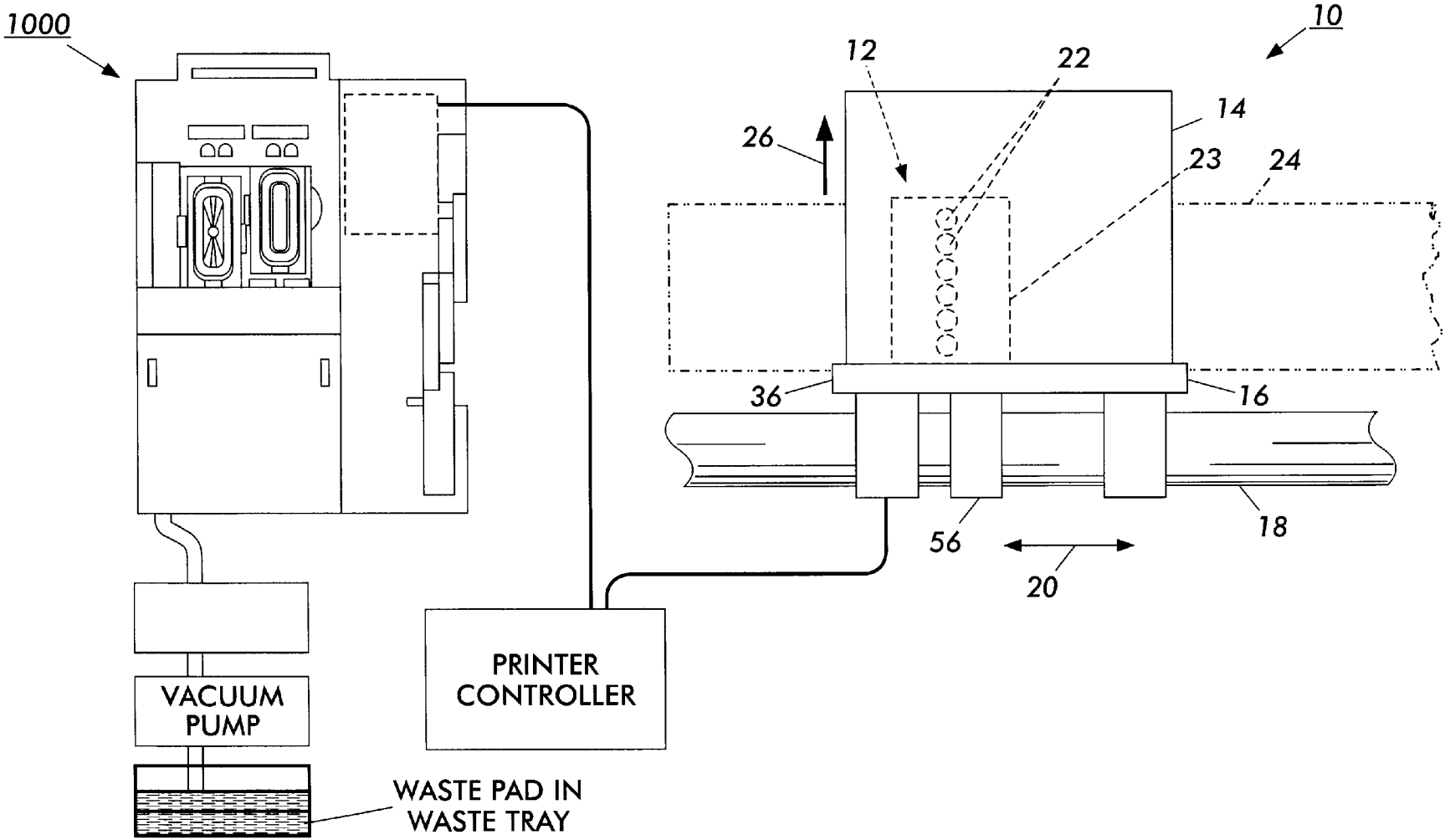
FIG. 1 is a schematic front elevation view of an ink jet printer and a maintenance station according to this invention.

FIG. 1 shows an ink jet printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by an arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the ink jet printer 10 is in a printing mode, the carriage 16 translates or reciprocates back and forth across and parallel to a printing zone 24 (shown in dashed line). Ink droplets are selectively ejected on demand from the printhead nozzles 22 onto a receiving medium, such as paper, positioned in the printing zone, to record information on the recording medium one swath or portion at a time. During each pass or translation in one direction of the carriage 16, the receiving medium is stationary. At the end of each pass, the recording medium is stepped in the direction of the arrow 26 for the at most distance or the height of one printed swath. U.S. Pat. No. 4,571,599 and Re. 32,572, each incorporated herein by reference in its entirety, provide a more detailed explanation of the printhead and the printing operation.

When the ink jet printer 10 is no longer in a printing mode, the carriage 16 travels to a maintenance station 1000 spaced from the printing zone 24, With the one or more printheads 12 positioned at the maintenance station 1000, various maintenance functions can be performed on the one or more printheads 12.

In contrast to copending U.S. patent application Ser. No. 09/594,693, incorporated herein by reference in its entirety, the cam shaft 100 rotates in a single direction. In various exemplary embodiments, this single direction is the counterclockwise direction. However, depending on the relative orientations of the various elements of the maintenance station, the cam shaft 100 can rotate only clockwise. Additionally, as described in U.S. patent application Ser. No. 09/594,695, incorporated herein by reference in its entirety, the cam shaft 100 can rotate in both a clockwise and counterclockwise direction, depending upon the activation required by a particular maintenance function and/or timing sequence.

Figure 2:
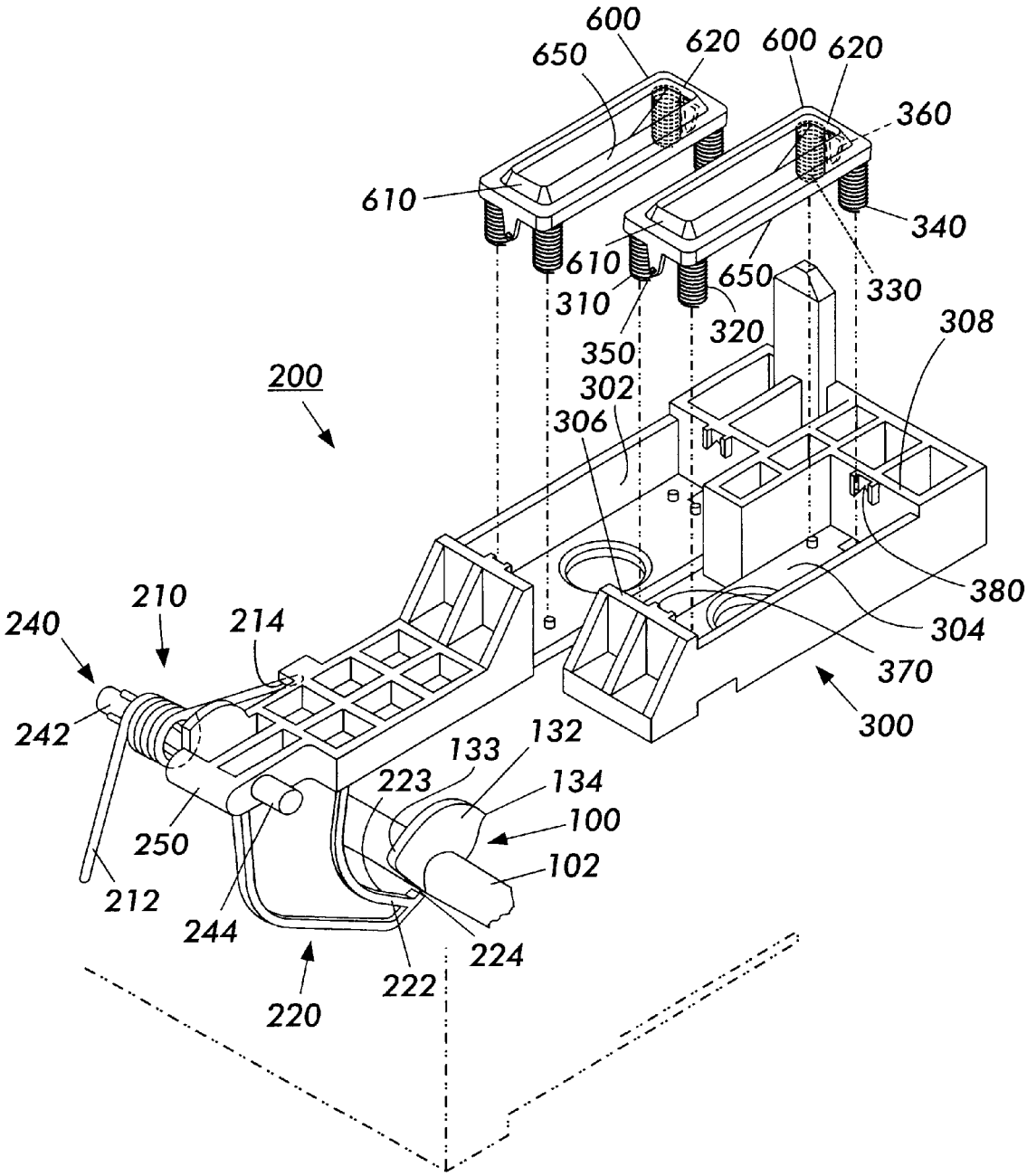
FIG. 2 is a top perspective view of the interior of the maintenance station of FIG. 1 according to this invention.

FIG. 2 is a top perspective view of the maintenance station 1000. As shown in FIG. 2, the maintenance station 1000 includes a cam shaft 100, a cam-actuated lever capping arm 200, and a cap carriage 300. In particular, as shown in FIG. 2, and more clearly seen in FIG. 3, the cam shaft 100 includes at least a driving and control portion 110, and a cam-actuated lever capping arm drive portion 130.

Figure 3:
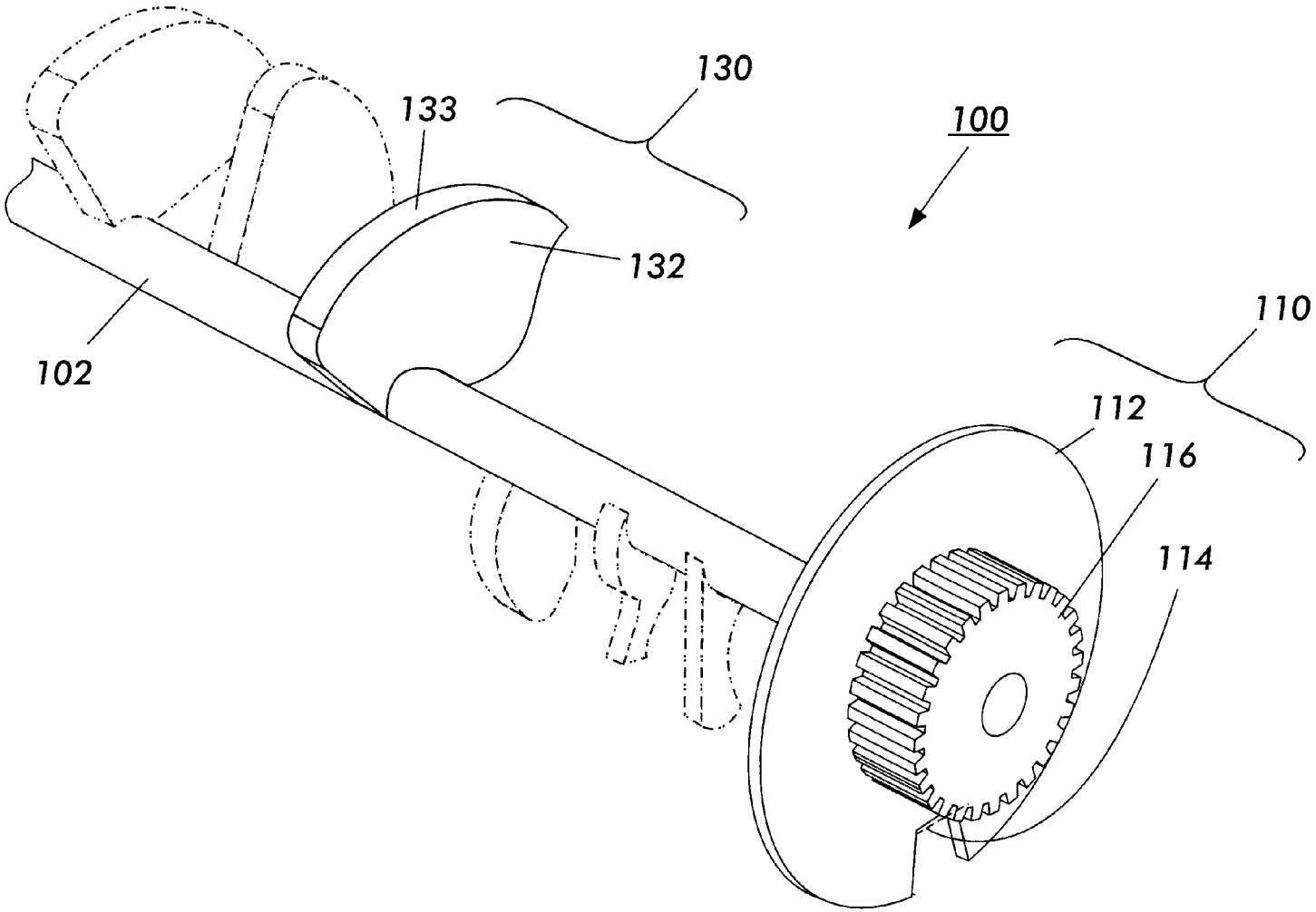
FIG. 3 is a partial perspective view of the cam shaft of FIG. 2.

In various exemplary embodiments, as shown in FIGS. 2 and 3, the driving and control portion 110 may, for example, include a sensor wheel 112, an optical window 114 formed in the sensor wheel 112, and a main drive gear 116. In operation, a drive gear train (not shown), comprising a drive motor connected to one or more drive gears, engages the main drive gear 116 to drive the cam shaft 100 in counterclockwise direction to actuate the various maintenance functions enabled by the maintenance station 1000. This is described in greater detail in copending U.S. patent application Ser. No. 09/594,694, incorporated herein by reference in its entirety.

In a first reference position of the cam shaft 100, the optical window 114 is aligned with an optical relay (not shown). Thus, after the drive gear train drives the main drive gear 116 to rotate the cam shaft 100, for example, one complete revolution, the optical window 114 formed in the sensor wheel 112 is again aligned with the optical relay. In various exemplary embodiments, the optical relay includes a photo-emitter positioned on one side of the sensor wheel 112 and a photo-detector positioned on the other side of the sensor wheel 112. When the optical window 114 is not aligned with the optical relay, the optical relay is in an opened circuit condition.

At the start of a maintenance operation, with the sensor wheel 112 at the first reference position and the optical window 114 is aligned with the optical relay to close the circuit through the optical relay. As a result, when the one or more printheads 12 are aligned with the maintenance station 1000 and the main drive gear 116 is initially driven in the counterclockwise direction, the optical window 114 is no longer aligned with the optical relay and the optical relay is placed into an open circuit condition. Then, the sensor wheel 112 again advances the window 114 into alignment with the optical relay. As a result, the optical relay is placed in the closed circuit condition.

The open and closed circuit conditions of the optical relay are sensed by a controller (not shown). In response, the controller stops the gear train engaged with the main drive gear 116 from turning the cam shaft 100 for a predetermined time. In particular, this predetermined time depends on the priming mode currently selected for the maintenance station 1000.

Once the predetermined time has elapsed, the controller starts the gear train to drive the main drive gear 116, and thus the cam shaft 100, in the counterclockwise direction. The cam shaft 100 continues rotating in the counterclockwise direction until the optical window 114 in the sensor wheel 112 is again aligned with the optical relay to again put the optical relay in a closed circuit condition. When the controller again senses the closed circuit condition of the optical relay, the controller again stops the gear train from driving the main drive gear 116, and thus the cam shaft 100, in the counterclockwise direction.

In particular, in various exemplary embodiments, depending on the rotational position of the camshaft 100, when the cam shaft 100 rotates in the counterclockwise direction, the cam-actuated lever capping arm drive portion 130 interacts with a cam-actuated lever arm 200 to move a cap carriage 300 from a disengaged position to an engaged position or from the engaged position to the disengaged position. The cap carriage 300 approaches the one or more printheads 12 at a slight angle from normal (i.e., perpendicular to the nozzle face 23), to rollingly engage the one or more printheads 12 with one or more printhead caps 600. The rolling engagement of the one or more printheads 12 with the one or more printhead caps 600 causes the leading edge portions 610 of the one or more printhead caps 600 to first contact the one or more printheads 12. As the cam shaft 100 continues to rotate further in the counterclockwise direction, the rolling engagement of the one or more printheads 12 with the one or more printhead caps 600 causes each of the one or more printhead caps 600 to gradually engage the printheads 12 until the trailing edge portions 620 of the one or more printhead caps 600 eventually contact the one or more printheads 12.

By rollingly engaging the one or more printheads 12 with the one or more printhead caps 600, the impact force is evenly distributed to the one or more printheads 12 through the entire time over which the one or more printhead caps 600 rollingly engages the one or more printheads 12. That is, rollingly engaging the one or more printheads with the impact force of the one or more printhead caps 600 tends to reduce the impact force against the one or more printheads 12, by spreading the contact force out over the period between the one or more printheads 12 contacting the leading edge portions 610 of the one or more printhead caps 600 and the trailing edge portions 620 of the one or more printhead caps 600. Additionally, in various exemplary embodiments, by spreading the contact force out over a period of time, the possibility of de-priming the one or more printheads 12 is reduced.

During the rolling engagement between the leading edge portions 610 of the one or more printhead caps 600 and the trailing edge portions 620 of the one or more printhead caps 600, the air contained in the one or more printhead caps 600 is allowed to escape before the one or more printhead caps 600 are fully engaged over the one or more printheads 12. By allowing the air to escape, and not forcing air down through the nozzles of the one or more printheads 12, the de-priming one or more printheads 12 becomes less likely.

In various exemplary embodiments, once in the engaged position, one or more printhead caps 600 carried by the cap carriage 300 remain engaged with the one or more printheads 12, while the cam shaft 100 continues to rotate in the counterclockwise direction. Several exemplary embodiments of the structure and operation of the printhead caps 600 are described in greater detail in copending U.S. patent applications Ser. No. 09/594,682 and 09/594,690 each incorporated herein by reference in its entirety.

As outlined above, the cap carriage 300 includes one or more printhead caps 600. As outlined above, when the cap carriage 300 is moved from the disengaged position to the engaged position by the cam-actuated capping lever arm 200, the one or more printhead caps 600 engage the nozzle faces 23 of one or more printheads 12. In particular, each of the printhead caps 600 needs to securely engage the nozzle face 23 of one of the one or more printheads 12 to ensure the negative pressure applied through one or more pinched tubes (not shown) is able to withdraw ink from the ink channels of the corresponding printhead 12.

That is, if the printhead cap 600 does not securely engage the nozzle face 23 of the corresponding printhead 12, the negative pressure applied through the one or more pinched tube (not shown) merely draws atmospheric into the interior of the printhead cap 600 rather than withdrawing ink from the ink channels of the corresponding printhead 12. Accordingly, in various exemplary embodiments of the printhead cap 600, the printhead caps 600 are provided with a compressible gasket 650. However, even with the compressible gasket 650, the printhead caps 600 cannot securely engage the printhead nozzle faces 23 if the printhead caps 600 are not substantially parallel to, and biased against, the nozzle faces 23.

Figure 4:
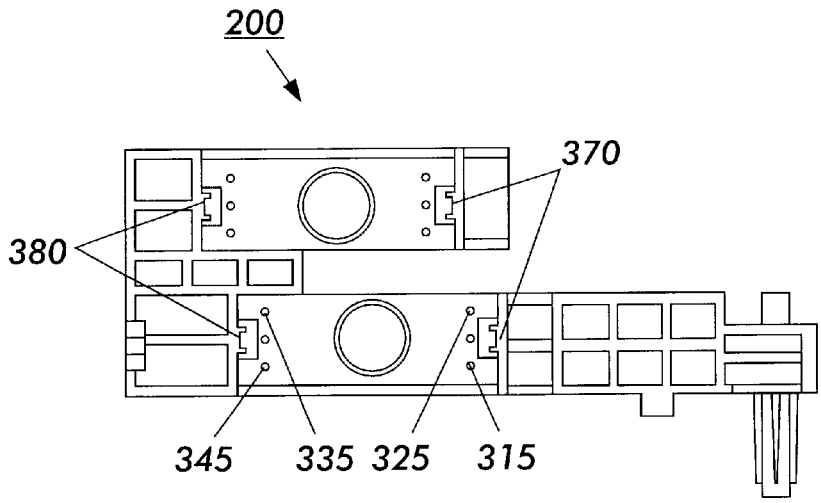
FIG. 4 is a top plan view of one exemplary embodiment of the cam-actuated lever capping arm according to this invention.

Accordingly, as shown in FIGS. 2 and 4, the printhead caps 600 are not mounted on the cap carriage 300 in a fixed position. Rather, as shown in FIG. 2, in various exemplary embodiments, printhead caps 600 are mounted using a cap gimbal structure. The cap carriage portion of the cap gimbal structure includes four support springs 310, 320, 330 and 340; four support tabs 315, 325, 335 and 345; two pivot tabs 350 and 360; and two pivot tab receiving slots 370 and 380.

The four support tabs 315, 325, 335 and 345 fit within and hold in position one end of the four support springs 310, 320, 330 and 340, on each of a first cap mounting position 302 and a second cap mounting position 304, of the cap carriage 300. The two pivot tabs 350 and 360 are located, respectively, on the leading edge portion 610 and the trailing edge portion 620, of the one or more printhead caps 600. The two pivot tab receiving slots 370 and 380 are located, respectively, on the leading wall portion 306 and the trailing wall portion 308, of a first cap mounting position 302, and a second cap mounting position 304, of the cap carriage 300. The two pivot tabs 350 and 360 slide into the two pivot receiving slots 370 and 380, to engage and biasedly support against the four support springs 310, 320, 330 and 340, the one or more printhead caps 600.

As a result, the printhead cap 600, using this gimbal structure according to this invention, has at least two degrees of rotational freedom. Accordingly, when that printhead cap 600 is biased against the corresponding nozzle face 23, the printhead cap 600 will securely engage the nozzle face 23 so that the negative pressure applied through the pinch tube (not shown) is able to withdraw ink from the ink channels of that printhead 12, rather than merely drawing ambient air from the region surrounding the nozzle face 23 of that printhead 12.

Likewise, after the cam-actuated lever capping arm drive portion 130 moves the capping station 300 from the disengaged position to the engaged position, the cam shaft 100 rotates further in the counterclockwise direction. As a result, in various exemplary embodiments, a pinch tube actuating portion actuates one or more pinch tubes to apply the negative pressure to the one or more printheads cap 600 mounted on the cap carriage 300. Several exemplary embodiments of the structure and operation of the pinch tubes and pinch mechanism is described in greater detail in copending U.S. patent application Ser. No. 09/594,680, incorporated herein by reference in its entirety. The cam shaft 100 then continues to rotate in the counterclockwise direction until the cam shaft 100 has traveled, for example, approximately 180 degrees from the first reference position. In various exemplary embodiments, the controller, based on the signal from the optical relay generated when the optical window 114 was in the first reference position and on the amount of rotation assumed for the cam shaft 100 since then, stops the cam shaft 100 when the cam shaft 100 is, for example, approximately 180 degrees out of alignment with the optical relay, and maintains the cam shaft 100 in that position for one of the predetermined times.

Then, after the predetermined time has elapsed, the controller engages the drive motor of the drive gear train to continue to rotate the cam shaft 100 in the counterclockwise direction. When the cam shaft 100 continues rotating in the counterclockwise direction, the pinch tube actuation portion again interacts with the one or more pinch tubes before the cap carriage 300 is moved from the engaged position to the disengaged position by the cam-actuated lever capping arm drive portion 130.

As shown in FIGS. 2 and 3, the various elements of the cam shaft drive portion 110, and the cam-actuated lever capping arm drive portion 130 are mounted on a shaft 102 of the cam shaft 100.

In the exemplary embodiments shown in FIGS. 2–5, the cam-actuated lever capping arm drive portion 130 of the cam shaft interacts with a cam-actuated lever arm 200 to move the cap carriage 300 from either the disengaged position to the engaged position against the one or more printheads 12, or from the engaged position against the one or more printheads 12 to the disengaged position. The cam-actuated lever capping arm 200 includes a biasing spring 210, as described in detail below. The biasing spring 210 operates in conjunction with the capping arm drive portion 130 to create a smooth transition of the cap carriage 300 from either the disengaged position to the engaged position against the one or more printheads 12, or from the engaged position against the one or more printheads 12 to the disengaged position. While the cam-actuated lever capping arm drive portion 130 can include, in various exemplary embodiments, a single drive portion 130, it should be appreciated that the drive portion 130, may include, in various other exemplary embodiments, one or more hold down cams 132 and one or more capping cams (not shown) that actuate, drive or bias, in conjunction with actuation and/or driving, one or more engaging portion 220 of the cam-actuated lever capping arm 200, as described in detail below.

Figure 5:
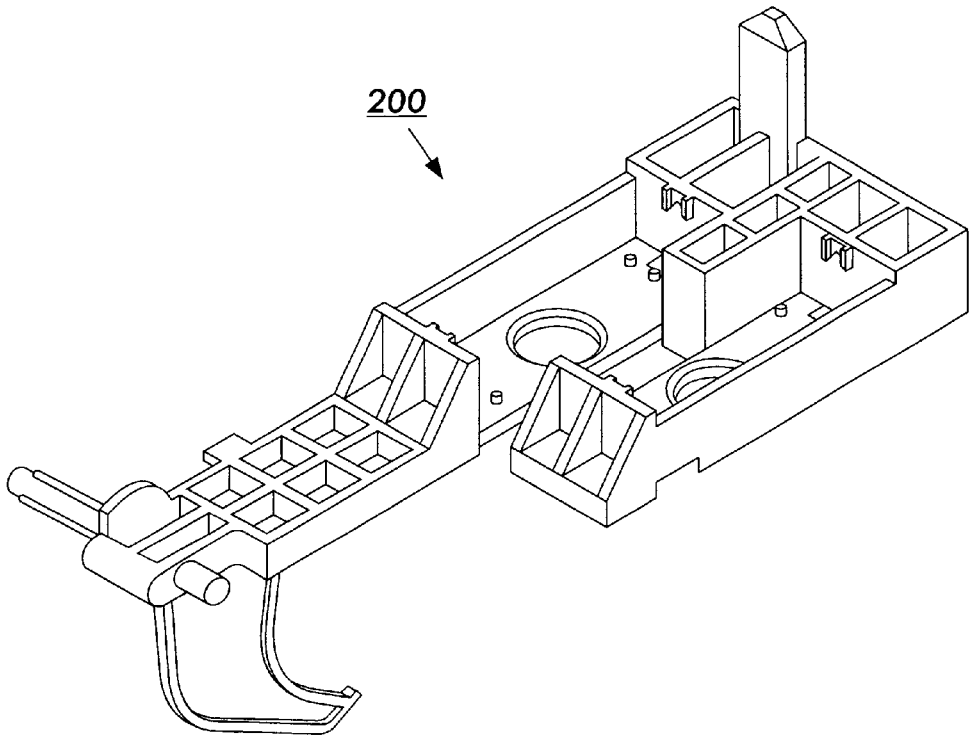
FIG. 5 is a partial perspective view of the cam-actuated lever capping arm.

FIGS. 4 and 5 show a top plan and a front perspective view, respectively, of the cam-actuated lever capping arm 200. When the cam shaft 100 is in the first reference position, the cam-actuated lever capping arm 200 is fully "lowered" to place the cap carriage 300 in the disengaged position.

As shown in FIGS. 2, 4 and 5, the cam-actuated lever capping arm 200 includes the biasing spring 210 having two maintenance station lever engaging portions 212 and 214, a cam engaging portion 220, a spring support shaft 240 having two end portions 242 and 244, and a lever arm portion 250. The spring support shaft 240 rotatably mounts the cam-actuated lever capping arm 200 in the maintenance station 1000, with the two end portions 242 and 244 supported within the maintenance station 1000. In various exemplary embodiments, the two end portions 242 and 244 of the mounting portion 240 "snap-fit" into a receiving structure (not shown) in the maintenance station 1000. In particular, the biasing spring 210 provides a bias force acting opposite the force applied by the cam-actuated lever capping arm drive portion 130 of the cam shaft 100 against the cam engaging portion 220 due to the counterclockwise rotation of the cam shaft 100.

In various exemplary embodiments, the cam engaging portion 220 includes a cam follower 222 having a curvilinear surface 223 and a protruding leading portion 224. When the cam shaft 100 rotates in the counterclockwise direction, the cam-actuated lever capping arm drive portion 130 interacts with various elements of the cam engaging portion 220.

In various exemplary embodiments, in conjunction with the biasing spring 210, the cam-actuated lever capping arm 200, may, for example, include a inverted cam surface as the curvilinear surface 223 of the cam follower 222 and a protruding follower portion 224. When the cam shaft 100 rotates in the counterclockwise direction, a hold-down cam surface 133 of a hold-down cam 132 engages the cam-actuated lever capping arm drive portion 130 of the inverted cam surface. The cam follower 222 contacting the hold-down cam 132 terminates at the protruding portion 224. The cam shaft 100, as it rotates counterclockwise, drives the hold-down cam surface 133 of the hold-down cam 132 against the inverted cam surface 223 of the cam follower 222 until the protruding follower portion 224 contacts a notch portion 134 of the hold-down cam surface 133.

After the hold-down cam 132 contacts the protruding portion 224, the cam-actuated capping arm is in its fully disengaged position from the one or more printheads 12. When the cam shaft 100 continues to rotate in the counterclockwise direction, beyond the contact with the notch portion 134 of the hold-down cam surface 133, the spring 210 and the hold-down cam 132, working in conjunction with each other, raise the lever arm 200 towards the engaged position so that the at least one cap 600 rollingly engage the at least one printheads 12.

In various exemplary embodiments, many individual systems cooperate to maintain and maximize the useful life of the one or more printheads 12, and may, for example, take place at a maintenance station. The maintenance station 1000, may be, for example, at one side of the printer, outside of the printing zone 24. At the end of a printing operation or upon the printer 10 terminating the printing mode, the carriage 16 is moved to the maintenance station 1000. With the one or more printhead nozzle faces 23 positioned adjacent to the maintenance station, the controller activates the maintenance station motor to drive the maintenance station gear train (not shown).

Thus, once the one or more printhead nozzle faces 23 are capped by the one or more caps 600, the controller may optionally have the one or more printheads 12 eject a number of ink droplets into the caps 600.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A maintenance station for a fluid ejection system having at least one fluid ejector head, comprising:

a cam shaft mounted to the maintenance station;

a hold down cam mounted on the cam shaft, the hold down cam having a convex-shaped portion;

a rotatably mounted lever arm mounted to the maintenance station and actuated by the cam shaft, the rotatably mounted lever arm having a hold down cam engaging portion that is engageable with the hold down cam, the hold down cam engaging portion further comprising a complimentary curvilinear recess terminating in a protruding follower portion; and a cap carriage having at least one cap, wherein, the hold down cam is constructed to engage the hold down cam engaging portion in response to a rotation of the cam shaft in a first direction to cause the rotatably mounted lever arm to rotate and move the cap carriage from a first position, where the at least one cap is disengaged from the at least one fluid ejector head, to a second position where the complimentary curvilinear recess interactively receives the convex-shaped portion of the hold down cam and the at least one cap rollingly engages the at least one fluid ejector head and the hold down cam further including a notch portion that provides a fully disengaged position for the lever arm.

2. The capping cam engaging portion of claim 1, further comprising:

a biasing member that biases the rotatably mounted lever arm to engage the cap.

* * * * *